US009372469B1

(12) United States Patent
Kawamata et al.

(10) Patent No.: US 9,372,469 B1
(45) Date of Patent: Jun. 21, 2016

(54) IMAGE FORMING SYSTEM AND RECORDING-MEDIUM STORAGE DEVICE

(71) Applicant: FUJI XEROX CO., LTD., Tokyo (JP)

(72) Inventors: Kunimasa Kawamata, Kanagawa (JP); Taku Kiyomasa, Kanagawa (JP); Yuji Otsuka, Kanagawa (JP); Hiroshi Kikuchi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/833,789

(22) Filed: Aug. 24, 2015

(30) Foreign Application Priority Data

Mar. 27, 2015 (JP) ..... 2015-067439

(51) Int. Cl.
*G03G 15/00* (2006.01)
*G03G 21/16* (2006.01)

(52) U.S. Cl.
CPC ..... *G03G 21/1623* (2013.01)

(58) Field of Classification Search
CPC ..... G03G 21/1623
USPC ..... 399/391
See application file for complete search history.

(56) References Cited

U.S. PATENT DOCUMENTS 4,788,571 A * 11/1988 Ura ..... B65H 1/04 271/171
5,441,246 A * 8/1995 Miyata ..... B41J 13/103 271/156
5,765,825 A * 6/1998 Watase ..... B65H 1/01 271/162
6,944,411 B2 * 9/2005 Iseki ..... G03G 15/5066 399/391
7,885,597 B2 * 2/2011 Gast ..... H04N 1/00567 271/162
2004/0052561 A1 * 3/2004 Ouchi ..... B65H 1/04 399/393
2005/0217524 A1 * 10/2005 Miyoshi ..... B65H 3/0833 101/477
2009/0066008 A1 * 3/2009 Hirose ..... B65H 3/44 271/9.01

FOREIGN PATENT DOCUMENTS

JP 2010-247976 A 11/2010

* cited by examiner

*Primary Examiner* — Anthony Nguyen
(74) *Attorney, Agent, or Firm* — Sughrue Mion, PLLC

(57) ABSTRACT

An image forming system includes an image forming apparatus that includes an image forming section which forms an image on a recording medium, and an opening/closing portion which is opened outward; and a recording-medium storage device that stores a recording medium to be fed to the image forming section, the recording-medium storage device being formed separately from the image forming apparatus and having a space allowing the opening/closing portion to be opened outward when the recording-medium storage device is connected to the image forming apparatus so as to cover the opening/closing portion.

5 Claims, 7 Drawing Sheets

IMAGE FORMING SYSTEM AND RECORDING-MEDIUM STORAGE DEVICE

CROSS-REFERENCE TO RELATED APPLICATIONS

This application is based on and claims priority under 35 USC 119 from Japanese Patent Application No. 2015-067439 filed Mar. 27, 2015.

BACKGROUND

Technical Field

The present invention relates to an image forming system and a recording-medium storage device.

SUMMARY

According to an aspect of the invention, there is provided an image forming system including an image forming apparatus that includes an image forming section which forms an image on a recording medium, and an opening/closing portion which is opened outward; and a recording-medium storage device that stores a recording medium to be fed to the image forming section, the recording-medium storage device being formed separately from the image forming apparatus and having a space allowing the opening/closing portion to be opened outward when the recording-medium storage device is connected to the image forming apparatus so as to cover the opening/closing portion.

BRIEF DESCRIPTION OF THE DRAWINGS

Exemplary embodiment of the present invention will be described in detail based on the following figures, wherein.

DETAILED DESCRIPTION

Referring to the attached drawings, an exemplary embodiment of the present invention will be described in detail.

Figure 1:
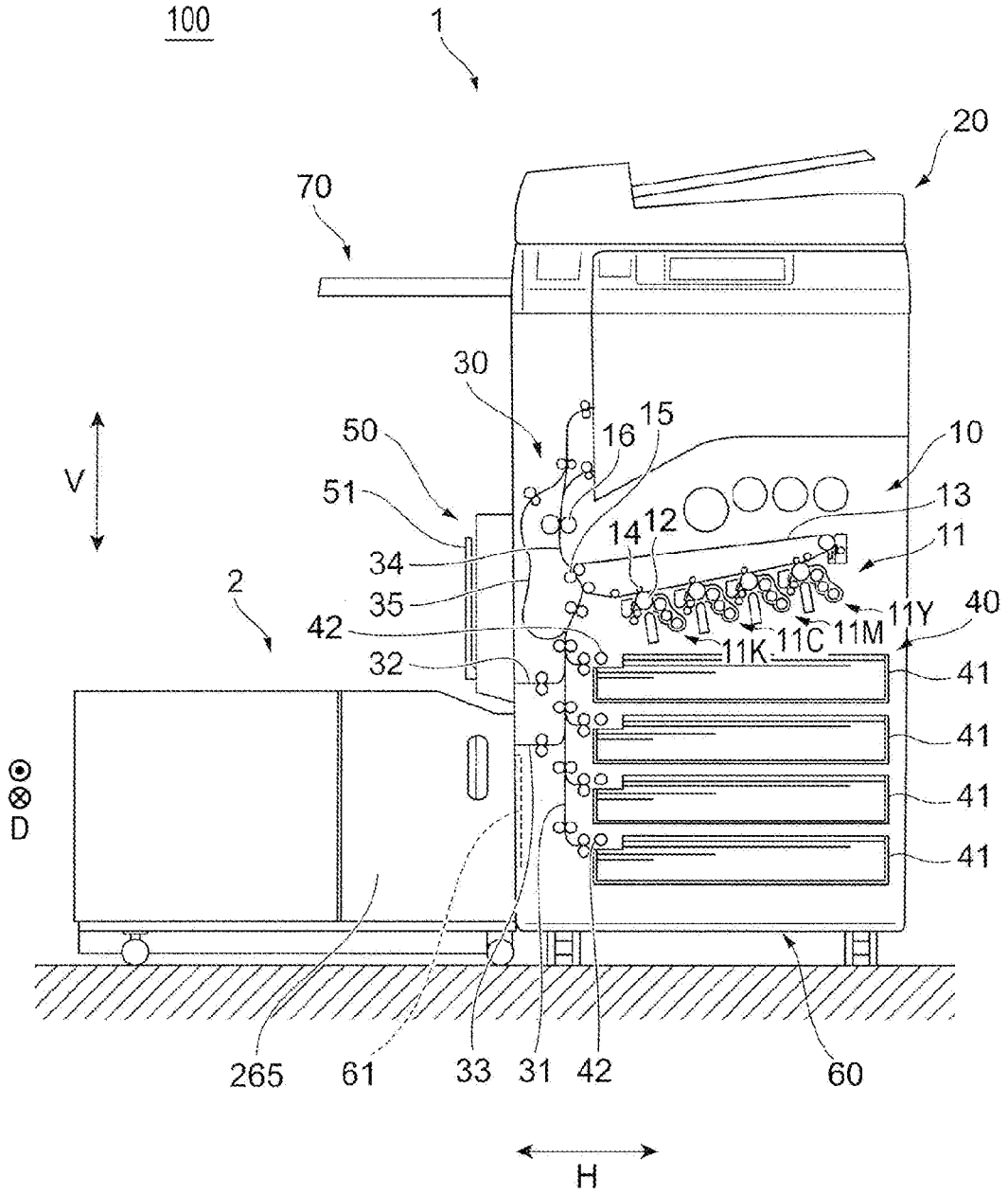
FIG. 1 shows the overall configuration of an image forming system according to an exemplary embodiment.

FIG. 1 shows the overall configuration of an image forming system 100 according to this exemplary embodiment.

Figure 2:
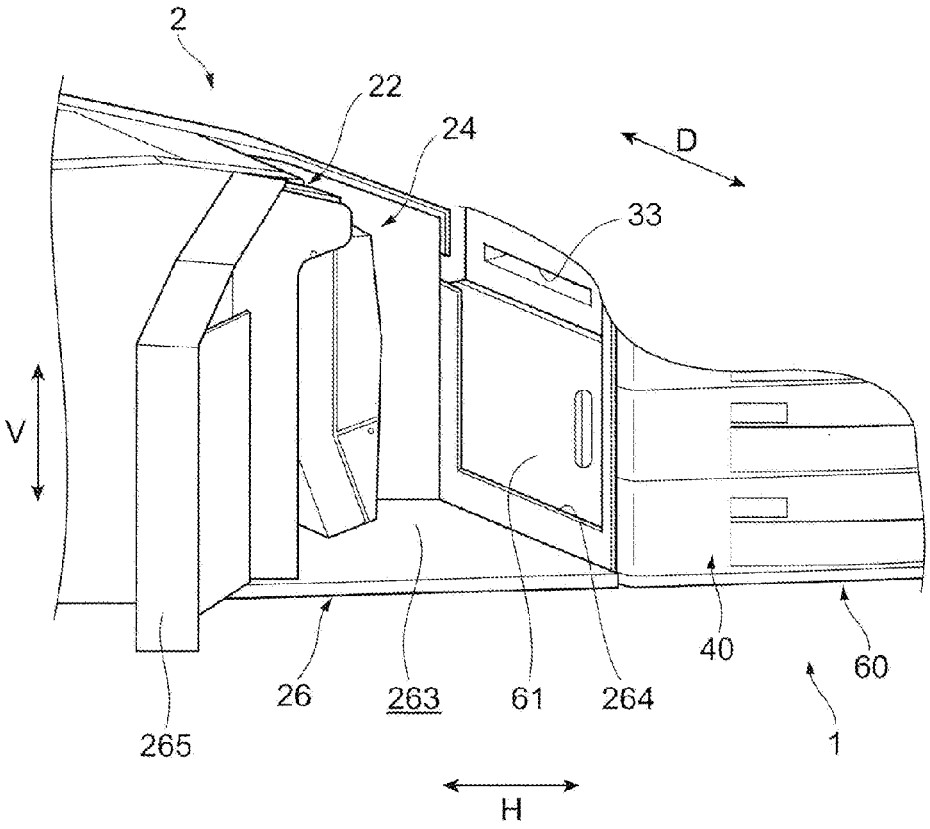
FIG. 2 is a perspective view of a large-capacity sheet feed device of the image forming apparatus and the vicinity thereof according to the exemplary embodiment.

FIG. 2 is a perspective view of a large-capacity sheet feed device 2 of the image forming apparatus 1 and the vicinity thereof according to this exemplary embodiment.

As shown in FIG. 1, the image forming system 100 includes an image forming apparatus 1 and a large-capacity sheet feed device 2 (an example of a recording-medium storage device) that feeds a sheet P (an example of a recording medium) to the image forming apparatus 1.

In the description below, a near-far direction, with respect to the plane of the sheet, of the image forming system 100 shown in FIG. 1 will be referred to as a "front-rear direction D"; a left-right direction, with respect to the plane of the sheet, of the image forming system 100 shown in FIG. 1 will be referred to as a "left-right direction H"; and a top-bottom direction, with respect to the plane of the sheet, of the image forming system 100 shown in FIG. 1 will be referred to as a "top-bottom direction V".

The image forming apparatus 1 includes an image forming section 10 that forms images according to color image data, an image reading unit 20 that reads an image on an original document, a sheet transporting system 30 that transports a sheet P, a first sheet-feed portion 40 that feeds a sheet P to the image forming section 10, and a second sheet-feed portion 50 that feeds a sheet P to the image forming section 10. The image forming apparatus 1 also includes a housing 60 that accommodates the image forming section 10, the sheet transporting system 30, and the first sheet-feed portion 40; and a work table 70 that is externally attached to the housing 60.

The large-capacity sheet feed device 2 is formed separately from the image forming apparatus 1 and is disposed next to the image forming apparatus 1. The large-capacity sheet feed device 2 according to this exemplary embodiment is removably attached to the housing 60.

A detailed description of the large-capacity sheet feed device 2 will be given below.

Function and Configuration of Image Forming Apparatus

The image forming section 10 includes four image forming units 11 (11Y, 11M, 11C, and 11K) that are arranged in a line at predetermined intervals. Each of the image forming units 11Y, 11M, 11C, and 11K includes a photoconductor drum 12 that forms an electrostatic latent image and carries a toner image, and forms a toner image by a so-called electrophotographic system. The image forming units 11Y, 11M, 11C, and 11K form a yellow (Y), magenta (M), cyan (C), and black (K) toner images, respectively.

The image forming section 10 also includes an intermediate transfer belt 13 to which color toner images formed on the photoconductor drums 12 of the image forming units 11 are transferred. The image forming section 10 also includes a first transfer roller 14 that sequentially transfers (first transfer) the color toner images formed by the image forming units 11 to the intermediate transfer belt 13. The image forming section 10 also includes a second transfer section 15 that batch-transfers (second transfer) the color toner images formed in a superimposed manner on the intermediate transfer belt 13 to a sheet P, and a fixing section 16 that fixes the color toner image transferred to the sheet P.

The image reading unit 20 sends image data of the image that it has read to a controller in the image forming section 10 or to an external device.

The sheet transporting system 30 includes a first transport path 31 along which a sheet P fed from the first sheet-feed portion 40 is transported to the second transfer section 15, a second transport path 32 along which a sheet P fed from the second sheet-feed portion 50 is transported to the second transfer section 15, a third transport path 33 along which a sheet P fed from the large-capacity sheet feed device 2 is transported to the second transfer section 15, a fourth transport path 34 along which a sheet P is transported from the second transfer section 15 to the fixing section 16, and a fifth transport path 35 along which a sheet P that has passed through the fixing section 16 is reversed and transported back to the second transfer section 15. Each transport path of the sheet transporting system 30 includes guide members that guide the sheet P and transport rollers that move the sheet P at the guide members.

The first sheet-feed portion 40 includes multiple sheet containers 41. Each sheet container 41 includes a pick-up roller 42 that picks up a sheet P stored. The first sheet-feed portion 40 picks up a sheet P from a sheet container 41 and feeds the sheet P toward the sheet transporting system 30.

The second sheet-feed portion 50 includes a manual feed tray 51 that forms a sheet-stacking surface on the outside of the image forming apparatus 1. The manual feed tray 51 is pivotable between an open position where the sheet-stacking surface faces up in the top-bottom direction V and a closed position where the sheet-stacking surface faces a side part of the housing 60.

Even when the manual feed tray 51 is closed, the second sheet-feed portion 50 according to this exemplary embodiment projects in the left-right direction H from the side of the housing 60.

As shown in FIG. 2, the housing 60 has an opening/closing door 61 (an example of an opening/closing portion). The opening/closing door 61 is provided opposite the first transport path 31 (see FIG. 1). When the opening/closing door 61 is opened outward, the first transport path 31 is exposed. In this exemplary embodiment, when a sheet P is jammed in, for example, the first transport path 31, it is possible to remove the sheet P by opening the opening/closing door 61.

As shown in FIG. 1, in the image forming apparatus 1 according to this exemplary embodiment, the large-capacity sheet feed device 2 is disposed so as to cover the opening/closing door 61. In this exemplary embodiment, an expression such as "the large-capacity sheet feed device 2 covers the opening/closing door 61" indicates not only a state in which the large-capacity sheet feed device 2 completely covers the opening/closing door 61, but also a state in which the large-capacity sheet feed device 2 covers a part of or a large part of the opening/closing door 61.

As shown in FIG. 1, the work table 70 is provided above the housing 60 in the top-bottom direction V. The work table 70 according to this exemplary embodiment is disposed on a side where the large-capacity sheet feed device 2 and the opening/closing door 61 are provided, in the left-right direction H of the housing 60. The work table 70 forms a surface projecting in the left-right direction H, on which an original document or the like is disposed.

Function and Configuration of Large-Capacity Sheet Feed Device

Figure 3:
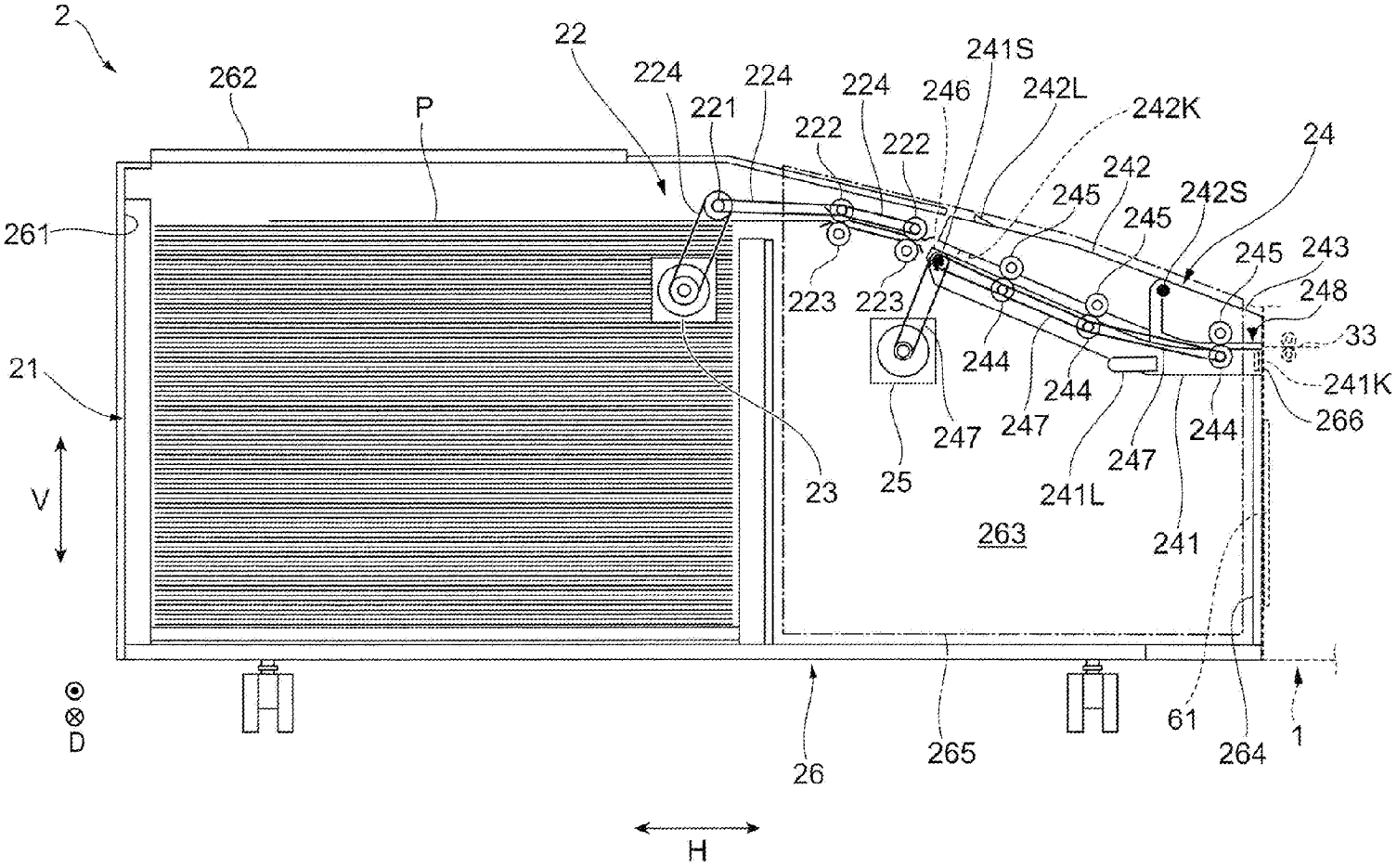
FIG. 3 shows the overall configuration of the large-capacity sheet feed device according to the exemplary embodiment.

FIG. 3 shows the overall configuration of the large-capacity sheet feed device 2 according to this exemplary embodiment.

The large-capacity sheet feed device 2 includes a container 21 that stores sheets P; a stationary passage portion 22 that forms a sheet transport passage between the container 21 and a movable passage portion 24 described below; a first driving motor 23 that supplies power for transporting a sheets P in the stationary passage portion 22; the movable passage portion 24 (an example of a transport passage portion) that forms a sheet transport passage between the stationary passage portion 22 and the image forming apparatus 1; a second driving motor 25 (an example of a driving portion) that supplies power for transporting the sheet P in the movable passage portion 24; and a housing portion 26 that accommodates or supports the container 21, the stationary passage portion 22, the first driving motor 23, the movable passage portion 24, and the second driving motor 25.

Container

The container 21 stores multiple sheets P. In this exemplary embodiment, the container 21 has a storage capacity of several thousands of sheets P. Furthermore, the container 21 includes a lifting mechanism (not shown). The container 21 makes the sheet P at the top of the stack oppose a pick-up roller 221 (described below) in the stationary passage portion 22, regardless of the number of sheets P stored.

Stationary Passage Portion

The stationary passage portion 22 includes the pick-up roller 221, first transport rollers 222, first pinch rollers 223, and first transmission belts 224.

The pick-up roller 221 picks up a sheet P stored in the container 21 and then feeds the sheet P to the first transport rollers 222 and the first pinch rollers 223 on the downstream side thereof.

There are multiple (in this exemplary embodiment, two) first transport rollers 222. The first transport rollers 222 transport the sheet P toward the movable passage portion 24 on the downstream side thereof.

The first pinch rollers 223 are provided so as to oppose the first transport rollers 222. In this exemplary embodiment, multiple (in this exemplary embodiment, two) first pinch rollers 223 are provided corresponding to the multiple first transport rollers 222. The first pinch rollers 223 rotate with the first transport rollers 222, while pinching the sheet P therebetween.

There are multiple (in this exemplary embodiment, three) first transmission belts 224. The first transmission belts 224 connect the first driving motor 23 and the pick-up roller 221, the pick-up roller 221 and the first transport roller 222, and two adjacent first transport rollers 222. The first transmission belts 224 transmit the rotational force generated by the first driving motor 23 to the pick-up roller 221 and to the first transport rollers 222.

First Driving Motor

The first driving motor 23 is operated according to control by a controller (not shown). The first driving motor 23 causes the pick-up roller 221 and the first transport rollers 222 to rotate via the first transmission belts 224.

Movable Passage Portion

The movable passage portion 24 includes a first guide member 241, a second guide member 242, a third guide member 243, second transport rollers 244 (an example of a transport roller), second pinch rollers 245, a transmission gear 246 (an example of a rotation member), second transmission belts 247, and a detection sensor 248.

In this exemplary embodiment, the whole movable passage portion 24 is pivotable about a first pivot shaft 241S (described below). The movable passage portion 24 may be either connected to the image forming apparatus 1 or away from the image forming apparatus 1. At least an end of the movable passage portion 24 closer to the image forming apparatus 1 is opposed to the third transport path 33 (see FIG. 1).

In either state in which the movable passage portion 24 is connected to or away from the image forming apparatus 1, the movable passage portion 24 according to this exemplary embodiment is located above the opening/closing door 61 in the top-bottom direction V. That is, in this exemplary embodiment, regardless of the state of the movable passage portion 24, the opening/closing door 61 may be moved outward and opened.

First Guide Member

The first guide member 241 is provided below the second guide member 242 and the third guide member 243. The first guide member 241 forms a transport path below the sheet P in the movable passage portion 24.

The first guide member 241 includes the first pivot shaft 241S, a first lock portion 241K, and a first lever 241L.

The first pivot shaft 241S extends in the front-rear direction D of the large-capacity sheet feed device 2 and is supported by the housing portion 26. The first pivot shaft 241S is provided at an end of the first guide member 241 closer to the container 21 in the left-right direction H. The first pivot shaft 241S supports the first guide member 241 in a pivotable manner.

The first lock portion 241K is provided at an end of the first guide member 241 closer to the image forming apparatus 1 in the left-right direction H. The first lock portion 241K is engaged with a connection portion 266 (described below) provided in the housing portion 26.

The first lever 241L is a part that is operated when connection between the first guide member 241 and the connection portion 266 via the first lock portion 241K is released. When the first lever 241L is operated, the first guide member 241 is disconnected from the connection portion 266 and becomes pivotable about the first pivot shaft 241S.

Second Guide Member

The second guide member 242 is located above the first guide member 241, on a side closer to the container 21 in the left-right direction H. The second guide member 242 is opposed to the first guide member 241, forming a sheet transport passage therebetween.

The second guide member 242 includes a second pivot shaft 242S, a second lock portion 242K, and a second lever 242L.

The second pivot shaft 242S extends in the front-rear direction D of the large-capacity sheet feed device 2 and is supported by the third guide member 243. The second pivot shaft 242S is provided at an end of the second guide member 242 closer to the image forming apparatus 1 in the left-right direction H. The second pivot shaft 242S supports the second guide member 242 in such a manner that the second guide member 242 is pivotable in a direction toward and away from the first guide member 241.

The second lock portion 242K is provided at an end of the second guide member 242 closer to the container 21 in the left-right direction H. The second guide member 242 may be connected to the first guide member 241 via the second lock portion 242K.

The second lever 242L is a part that is operated when connection between the second guide member 242 and the first guide member 241 via the second lock portion 242K is released. When the second lever 242L is operated, the second guide member 242 is disconnected from the first guide member 241 and becomes pivotable about the second pivot shaft 242S.

Third Guide Member

The third guide member 243 is located above the first guide member 241, at an end closer to the image forming apparatus 1 in the left-right direction H. The third guide member 243 is opposed to the first guide member 241, forming a sheet transport passage therebetween.

In this exemplary embodiment, the end of the third guide member 243 is located closer to the container 21 than the outer end of the second sheet-feed portion 50 (see FIG. 1) is. Hence, pivoting of the second guide member 242 is not inhibited by the second sheet-feed portion 50.

There are multiple (in this exemplary embodiment, three) second transport rollers 244. The second transport rollers 244 are provided on the first guide member 241. The second transport rollers 244 transport the sheet P toward the third transport path 33 on the downstream side thereof.

The second pinch rollers 245 are provided so as to oppose the second transport rollers 244. In this exemplary embodiment, multiple (in this exemplary embodiment, three) second pinch rollers 245 are provided corresponding to the multiple second transport rollers 244. The second pinch rollers 245 rotate with the second transport rollers 244, while pinching the sheet P therebetween.

The transmission gear 246 is rotatably supported by the first pivot shaft 241S. The transmission gear 246 according to this exemplary embodiment is provided coaxially with the first pivot shaft 241S.

There are multiple (in this exemplary embodiment, three) second transmission belts 247. The second transmission belts 247 connect the second driving motor 25 and the transmission gear 246, the transmission gear 246 and the second transport roller 244, and two adjacent second transport rollers 244. The second transmission belts 247 transmit the rotational force generated by the second driving motor 25 to the transmission gear 246 and to the second transport rollers 244.

In this exemplary embodiment, the detection sensor 248 is provided in the third guide member 243. The detection sensor 248 detects the presence/absence of a sheet P at the opposite position. In this exemplary embodiment, for example, the detection sensor 248 detects a situation where a sheet P is jammed in the stationary passage portion 22 or the movable passage portion 24 or a situation where a sheet P spreads over the large-capacity sheet feed device 2 and the image forming apparatus 1.

Second Driving Motor

As described above, the second driving motor 25 causes the transmission gear 246 and the second transport rollers 244 to rotate via the second transmission belts 247.

Housing Portion

As shown in FIG. 3, the housing portion 26 includes a container holding portion 261, a cover portion 262, a space forming portion 263 (an example of a space), an opening 264, an opening/closing door 265, and the connection portion 266.

The container holding portion 261 covers the periphery of the container 21 and holds the container 21.

The cover portion 262 is provided on the container 21 in a movable manner. The cover portion 262 is switchable between a state in which it covers the container 21 and a state in which it uncovers the container 21. In this exemplary embodiment, sheets P are loaded into the container 21 through the cover portion 262 opened.

The space forming portion 263 is provided between the container holding portion 261 and the image forming apparatus 1. The space forming portion 263 is provided adjacent to the opening/closing door 61 in the image forming apparatus 1. The space forming portion 263 forms a space that is larger than, at least, the area of the path along which the movable passage portion 24 is pivoted. Furthermore, the space forming portion 263 forms a space that is larger than, at least, the area of the path along which the opening/closing door 61 is moved when it is opened or closed.

The space forming portion 263 forms a space that allows the opening/closing door 61 to be opened outward, with the large-capacity sheet feed device 2 being connected to the image forming apparatus 1.

The opening 264 is provided at a position where the large-capacity sheet feed device 2 adjoins the image forming apparatus 1. The opening 264 is provided so as not to block the opening/closing door 61 when the large-capacity sheet feed device 2 is disposed next to the image forming apparatus 1 (see FIG. 2).

The opening/closing door 265 is provided in a side part of the housing portion 26 on the near side in the front-rear direction D of the large-capacity sheet feed device 2. In this exemplary embodiment, the opening/closing door 265 is provided on a side closer to the opening 264 in the left-right direction H. In this exemplary embodiment, the opening 264 is exposed by opening the opening/closing door 265 (see FIG. 2).

As shown in FIG. 3, the connection portion 266 is a portion with which the first lock portion 241K provided on the first guide member 241 is engaged. The connection portion 266 according to this exemplary embodiment is a hole provided in a part of the housing portion 26, such that the movable passage portion 24 is located at a predetermined position relative to the third transport path 33.

Operation of Large-Capacity Sheet Feed Device

Figure 4A:
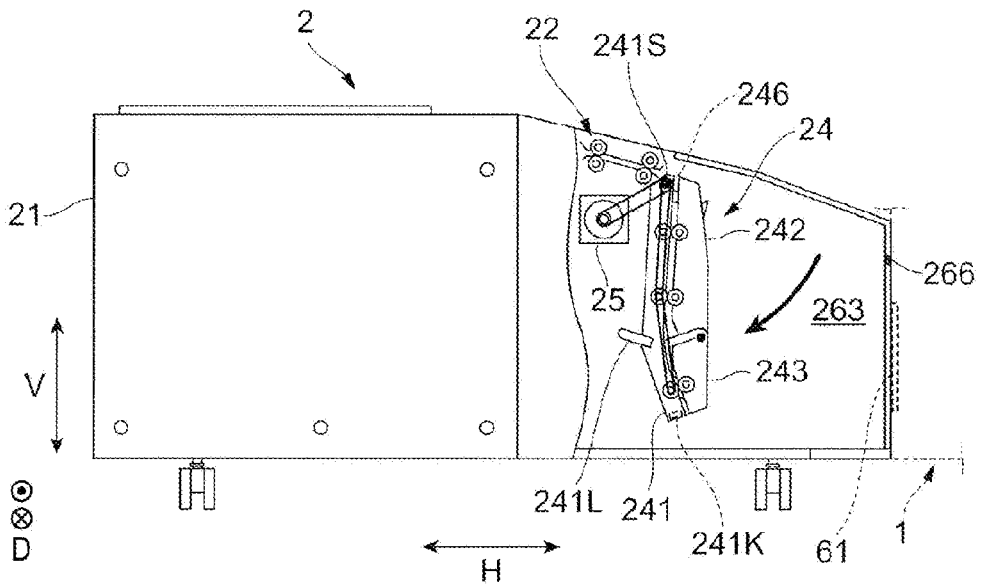
FIGS. 4A and 4B show the movement of the large-capacity sheet feed device according to the exemplary embodiment.
Figure 4B:
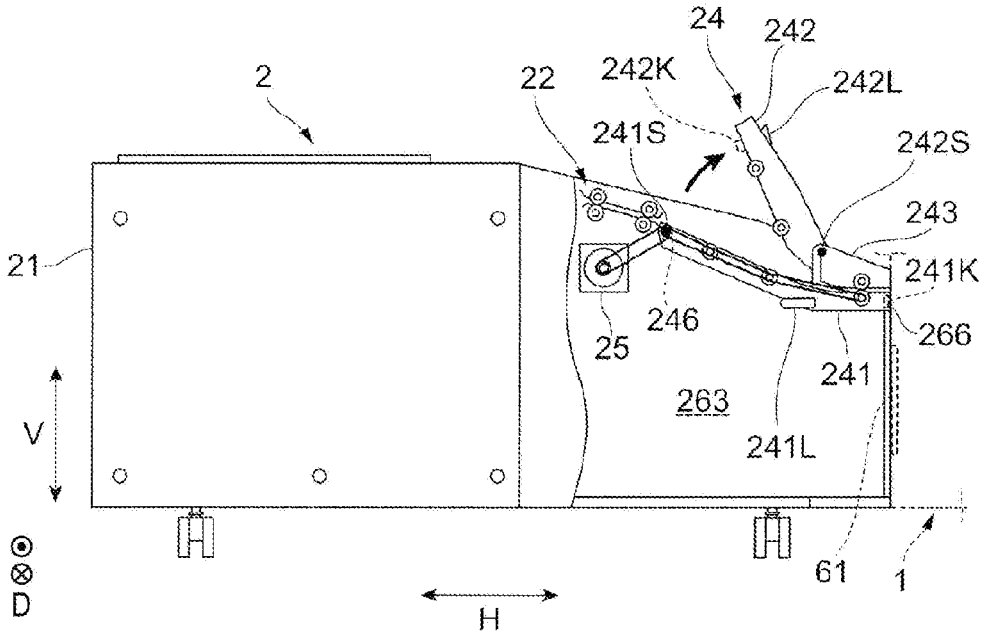

FIGS. 4A and 4B show the movement of the large-capacity sheet feed device 2 according to this exemplary embodiment.

In the large-capacity sheet feed device 2 configured as above, a sheet P is fed from the container 21 due to actuation of the first driving motor 23 and the second driving motor 25 (see FIG. 3). The sheet P is transported along the stationary passage portion 22 and the movable passage portion 24 and is then fed to the third transport path 33. In this way, the large-capacity sheet feed device 2 feeds the sheet P to the image forming apparatus 1. Then, in the image forming apparatus 1, the image forming section 10 forms an image on the sheet P (see FIG. 1).

A case where a paper jam occurs in, for example, the first transport path 31 of the image forming apparatus 1 will be described.

In this case, in the image forming system 100 according to this exemplary embodiment, first, the opening/closing door 265 of the large-capacity sheet feed device 2 is opened (see FIG. 2).

Then, as shown in FIG. 4A, the first lever 241L of the movable passage portion 24 is operated to unlock the first lock portion 241K. This operation allows the movable passage portion 24 to pivot downward, in the top-bottom direction V, about the first pivot shaft 241S. The movable passage portion 24 moves away from the opening/closing door 61 of the image forming apparatus 1.

In the movable passage portion 24, the first pivot shaft 241S and the transmission gear 246 are provided coaxially. Thus, no special operation, such as disconnecting the second driving motor 25 and the movable passage portion 24, is needed to pivot the movable passage portion 24.

Furthermore, by opening the opening/closing door 61, the third transport path 33 (see FIG. 1) is exposed. In this exemplary embodiment, the opening/closing door 61 is located below the movable passage portion 24. Hence, by pivoting the movable passage portion 24, an operator may open the opening/closing door 61 and easily remove the sheet P that is stuck in the third transport path 33, without needing to take an unnatural posture. Of course, in the large-capacity sheet feed device 2 according to this exemplary embodiment, there is no need to move the container 21 accommodating a large number of sheets P or the whole large-capacity sheet feed device 2 to open the opening/closing door 61.

Next, a case where a paper jam occurs in the large-capacity sheet feed device 2, specifically, for example, in the movable passage portion 24, will be described.

In this case, as shown in FIG. 4B, the second lever 242L of the movable passage portion 24 is operated to unlock the second lock portion 242K. Then, the second guide member 242 is moved. As a result, the portion where the second guide member 242 and the first guide member 241 has been opposed to each other is exposed, making it possible to remove the sheet P that is stuck in the large-capacity sheet feed device 2.

Large-Capacity Sheet Feed Device according to Modification 1

A large-capacity sheet feed device 2 according to Modification 1 will be described.

Figure 5A:
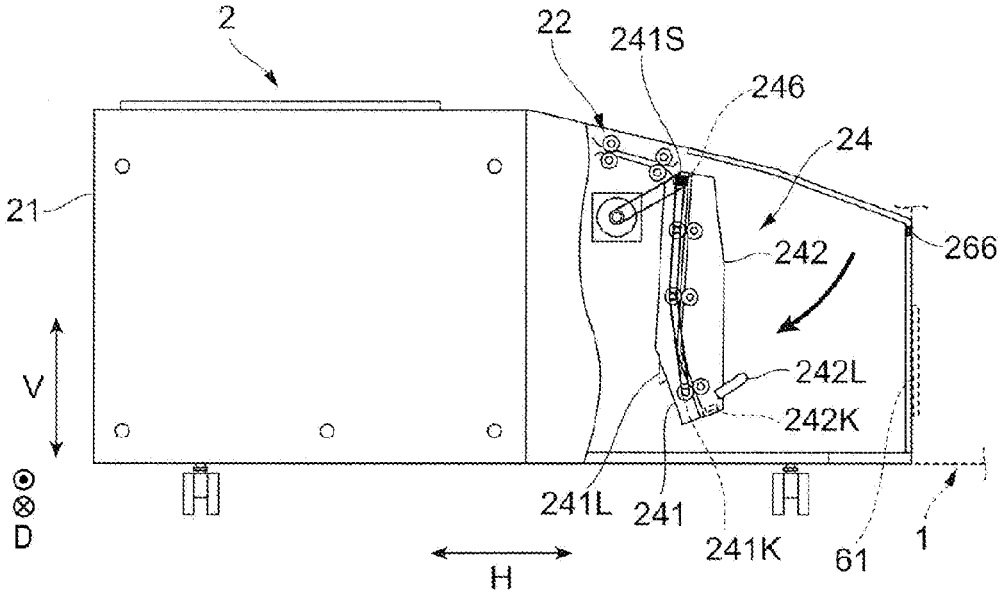
FIGS. 5A and 5B show the overall configuration of the large-capacity sheet feed device according to Modification 1.
Figure 5B:
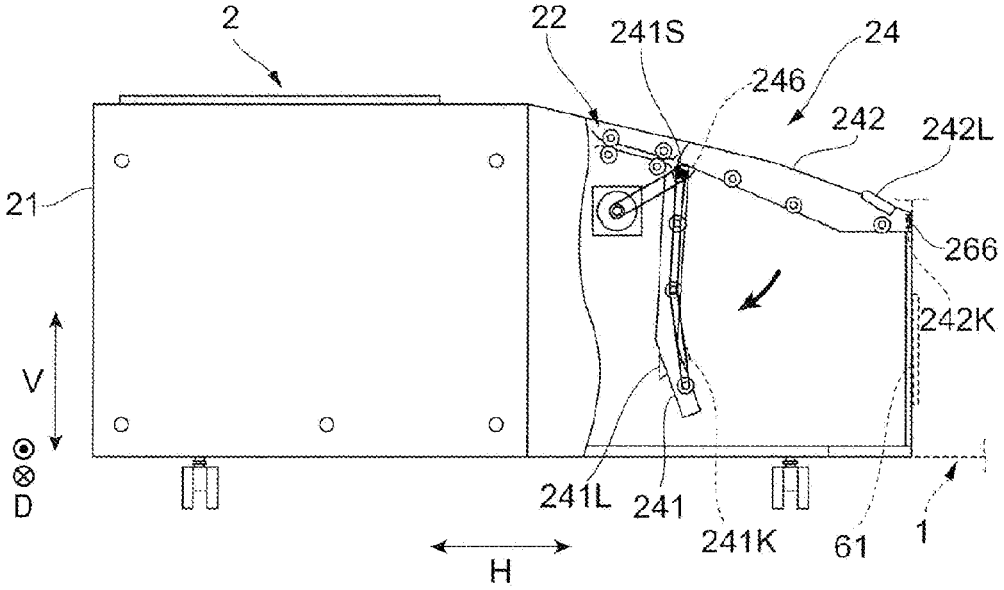

FIGS. 5A and 5B show the overall configuration of the large-capacity sheet feed device 2 according to Modification 1.

In the large-capacity sheet feed device 2 according to Modification 1, the movable passage portion 24 does not have the third guide member 243. In the large-capacity sheet feed device 2 according to Modification 1, the sheet transport passage is formed of the first guide member 241 and the second guide member 242.

The second guide member 242 according to Modification 1 pivots about the first pivot shaft 241S of the first guide member 241.

In the first guide member 241 according to Modification 1, the first lock portion 241K is connectable to the second guide member 242. In Modification 1, the first guide member 241 is not connected to the connection portion 266.

Furthermore, in the second guide member 242 according to Modification 1, the second lock portion 242K is connectable to the connection portion 266 of the housing portion 26.

The operation of the thus-configured large-capacity sheet feed device 2 according to Modification 1 will be described.

When the movable passage portion 24 according to Modification 1 is to be pivoted, as shown in FIG. 5A, the second lever 242L is operated. By doing so, the second guide member 242 and the housing portion 26 are disconnected. At this time, the first guide member 241 is connected to the second guide member 242, but not to the housing portion 26. Hence, the first guide member 241 and the second guide member 242 are integrally pivoted downward in the top-bottom direction V. That is, the movable passage portion 24 is pivoted downward.

When the first guide member 241 is to be pivoted, as shown in FIG. 5B, the first lever 241L is operated. By doing so, the first guide member 241 is disconnected from the second guide member 242. As a result, in Modification 1, only the first guide member 241 is pivoted downward in the top-bottom direction V.

As described above, also in the movable passage portion 24 according to Modification 1, similarly to the above-described exemplary embodiment, either or both of the first guide member 241 and the second guide member 242 pivot.

Large-Capacity Sheet Feed Device According to Modification 2

Figure 6A:
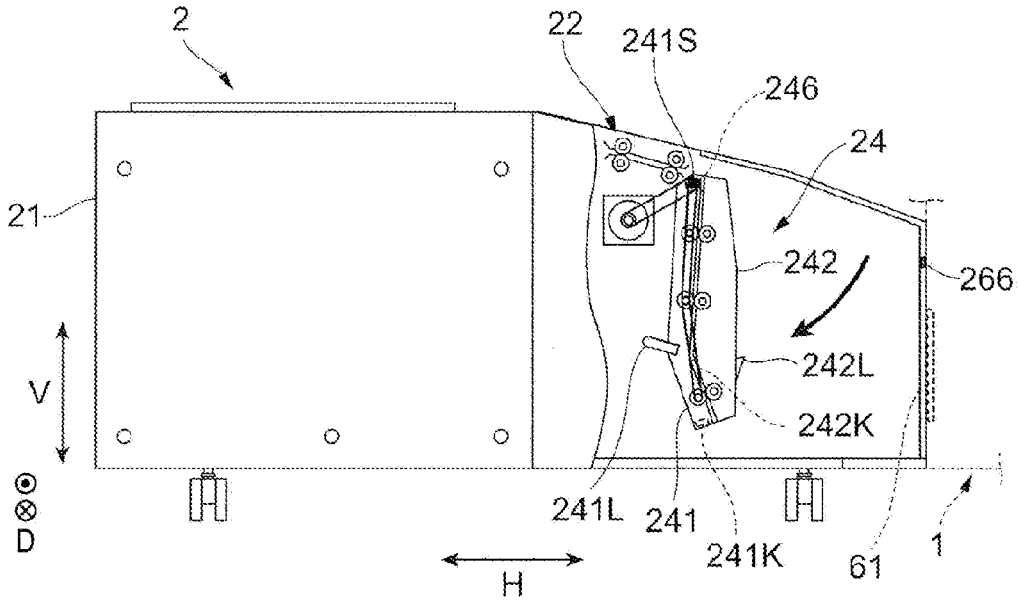
FIGS. 6A and 6B show the overall configuration of the large-capacity sheet feed device according to Modification 2.
Figure 6B:
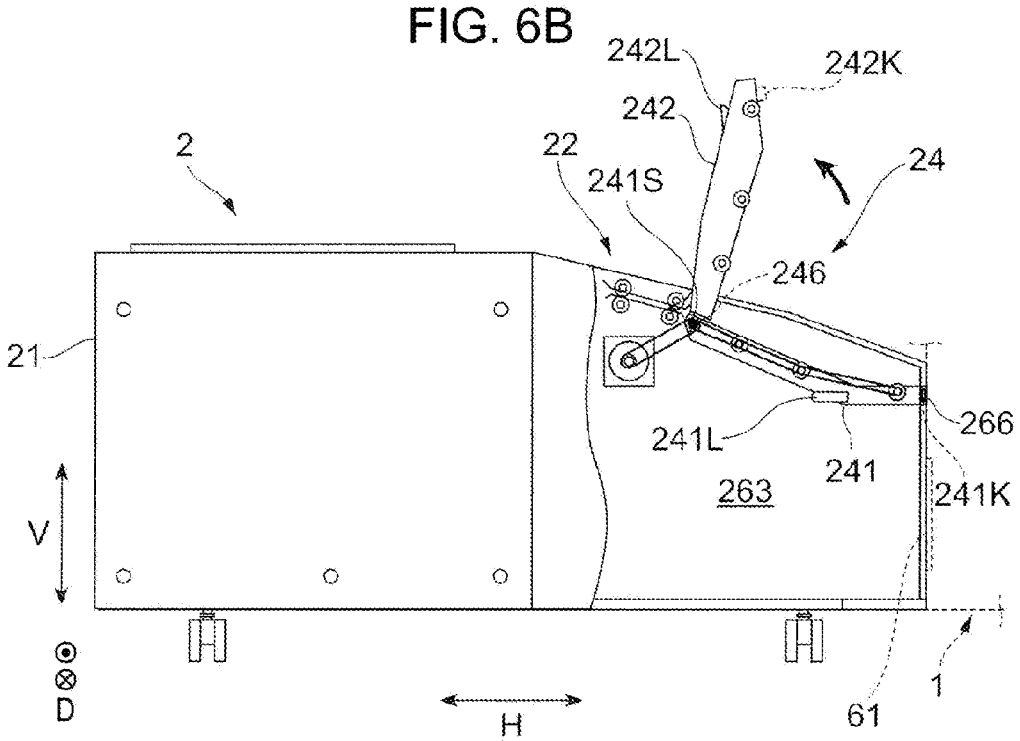

FIGS. 6A and 6B show the overall configuration of the large-capacity sheet feed device 2 according to Modification 2.

In the large-capacity sheet feed device 2 according to Modification 2, the movable passage portion 24 does not have the third guide member 243. In the large-capacity sheet feed device 2 according to Modification 2, the sheet transport passage is formed of the first guide member 241 and the second guide member 242.

The second guide member 242 according to Modification 2 pivots about the first pivot shaft 241S of the first guide member 241. Hence, the second guide member 242 is pivotable about the first pivot shaft 241S that is positioned closer to the container 21 in the left-right direction H.

The operation of the thus-configured large-capacity sheet feed device 2 according to Modification 2 will be described.

When the movable passage portion 24 according to Modification 2 is to be pivoted, as shown in FIG. 6A, the first lever 241L is operated. By doing so, the first guide member 241 and the second guide member 242 are integrally pivoted downward in the top-bottom direction V. That is, the movable passage portion 24 is pivoted downward.

When the second guide member 242 is to be pivoted, as shown in FIG. 6B, the second lever 242L is operated. By doing so, the second guide member 242 is disconnected from the first guide member 241. As a result, in Modification 2, only the second guide member 242 is pivoted upward in the top-bottom direction V.

As described above, also in the movable passage portion 24 according to Modification 2, similarly to the above-described exemplary embodiment, either or both of the first guide member 241 and the second guide member 242 pivot.

Large-Capacity Sheet Feed Device According to Modification 3

Figure 7A:
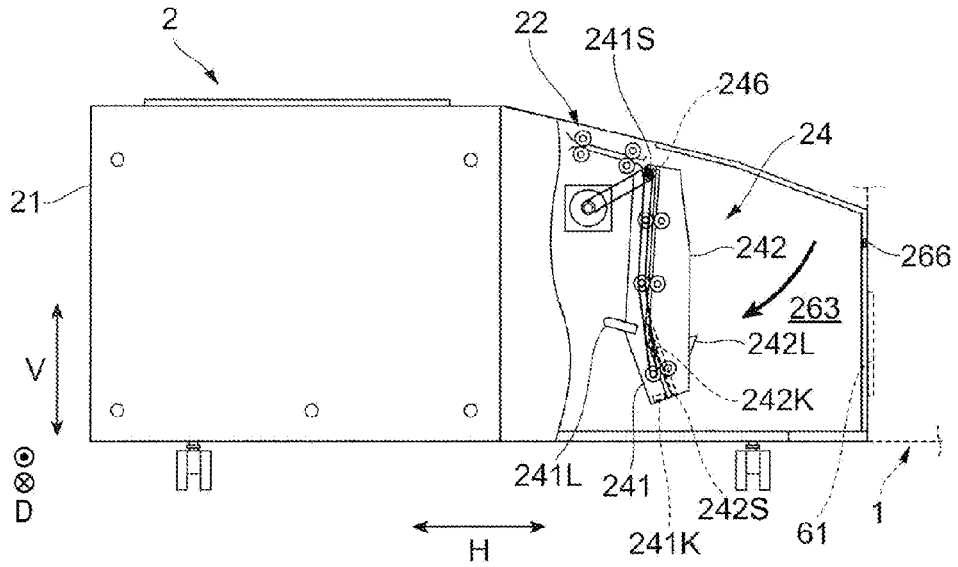
FIGS. 7A and 7B show the overall configuration of the large-capacity sheet feed device according to Modification 3.
Figure 7B:
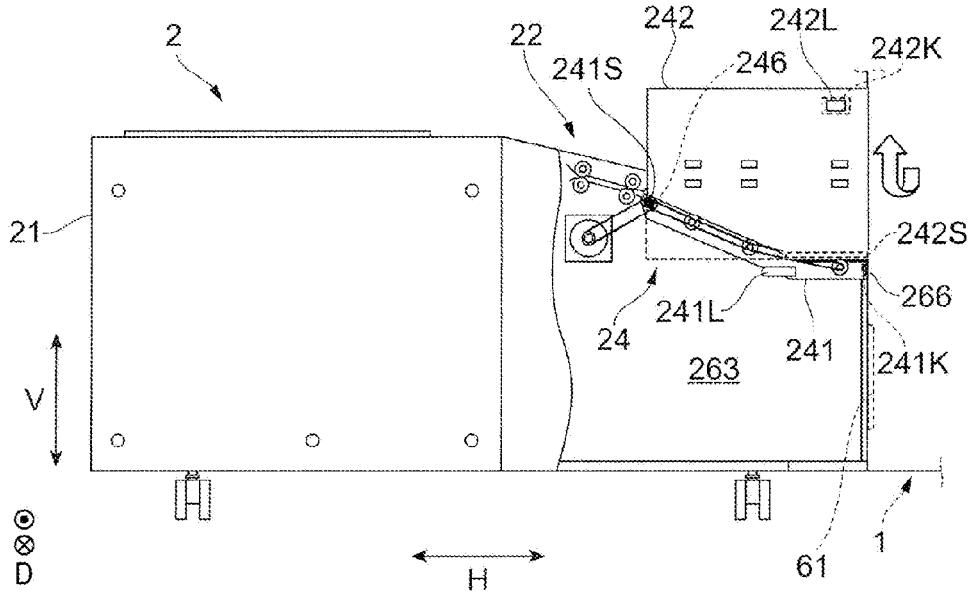

FIGS. 7A and 7B show the overall configuration of the large-capacity sheet feed device 2 according to Modification 3.

In the large-capacity sheet feed device 2 according to Modification 3, the movable passage portion 24 does not have the third guide member 243. In the large-capacity sheet feed device 2 according to Modification 3, the sheet transport passage is formed of the first guide member 241 and the second guide member 242.

The second pivot shaft 242S of the second guide member 242 according to Modification 3 extends in the longitudinal direction of the second guide member 242. The second pivot shaft 242S is disposed on the rear side in the front-rear direction D. The second pivot shaft 242S is supported by the first guide member 241. The second guide member 242 according to Modification 3 is pivotable in the top-bottom direction V, about the second pivot shaft 242S disposed on the rear side in the front-rear direction D.

The operation of the thus-configured large-capacity sheet feed device 2 according to Modification 3 will be described.

When the movable passage portion 24 according to Modification 3 is to be pivoted, as shown in FIG. 7A, the first lever 241L is operated. By doing so, the first guide member 241 and the second guide member 242 are integrally pivoted downward in the top-bottom direction V. That is, the movable passage portion 24 is pivoted downward.

When the second guide member 242 is to be pivoted, as shown in FIG. 7B, the second lever 242L is operated. By doing so, the second guide member 242 is disconnected from the first guide member 241. As a result, in Modification 3, only the second guide member 242 is pivoted upward in the top-bottom direction V. In particular, in the large-capacity sheet feed device 2 according to Modification 3, because the second pivot shaft 242S is disposed on the rear side, the second guide member 242 is moved toward the near side. This makes the work of a user easy because the front side, at which the user typically does the work, is opened. Furthermore, the working efficiency in the case where, for example, the work table 70 is provided above the large-capacity sheet feed device 2, as in the image forming apparatus 1 according to this exemplary embodiment, improves.

As described above, also in the movable passage portion 24 according to Modification 3, similarly to the above-described exemplary embodiment, either or both of the first guide member 241 and the second guide member 242 pivot.

In the image forming apparatus 1 according to this exemplary embodiment, the opening/closing door 61 is formed independently of the opening through which a sheet P is introduced into the third transport path 33. In contrast, for example, the opening/closing door 61 is sometimes formed integrally with the opening through which a sheet P is introduced into the third transport path 33. Also in such a case, in the large-capacity sheet feed device 2 according to this exemplary embodiment, the movable passage portion 24 moves away from the opening/closing door 61. Hence, it is possible to open the opening/closing door 61, without moving the container 21 or the whole large-capacity sheet feed device 2.

Although the opening/closing portion, to which the large-capacity sheet feed device 2 is opposed, is the opening/closing door 61 that covers or uncovers the first transport path 31 and the vicinity thereof in the image forming system 100 according to this exemplary embodiment, the opening/closing portion is not limited to this example. That is, the opening/closing portion, to which the large-capacity sheet feed device 2 is opposed, may be a door that covers or uncovers another component. Moreover, the opening/closing portion, to which the large-capacity sheet feed device 2 is opposed, is not limited to a door, but may be, for example, a structure that moves back and forth in one direction, like a drawer.

Although the movable passage portion 24 is configured to move away from the opening/closing door 61 by being pivoted in this exemplary embodiment, the movable passage portion 24 may be configured to move away from the opening/closing door 61 by being moved in the top-bottom direction V or in the front-rear direction D.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming system comprising:

an image forming apparatus including:

an image forming section configured to form an image on a recording medium, and an opening/closing portion configured to open in a direction away from the image forming section;

a recording-medium storage device configured to store a recording medium configured to be used by the image forming section, the recording-medium storage device being a separate device from the image forming apparatus and having a space configured to receive the opening/closing portion when the opening/closing portion is opened; and a transport passage portion configured to form a path along which the recording-medium stored in the recording-medium storage device is transported toward the image forming section, the transport passage portion configured to move in a direction away from the image forming apparatus, wherein the transport passage portion includes a first part configured to face the recording-medium storage device and a second part configured to face the image forming apparatus, the transport passage portion configured to pivot about a pivot shaft provided on the second part, and wherein when the recording-medium storage device is connected to the image forming apparatus, the recording medium storage device covers the opening/closing portion.

2. The image forming system according to claim 1, the transport passage portion being provided so as to be movable in a direction away from the opening/closing portion.

3. A recording-medium storage device comprising:

a container being a device separate from an image forming apparatus, the container storing a recording medium configured to be used with the image forming section; and a transport passage portion configured to form a path along which a recording medium stored in the container is transported toward the image forming section, the transport passage portion configured to move in a direction away from the image forming apparatus, wherein the transport passage portion includes a first part configured to face the container and a second part configured to face the image forming apparatus, the transport passage portion configured to pivot about a pivot shaft provided on the second part.

4. The recording-medium storage device according to claim 3, further comprising:

a transport roller provided on the transport passage portion and configured to transport the recording medium; and a driving portion configured to cause the transport roller to rotate via a rotation member provided coaxially with the pivot shaft.

5. The recording-medium storage device according to claim 3, wherein the transport passage portion includes a first guide portion configured to face one side of a recording medium and configured to guide the recording medium and a second guide portion configured to face the other side of the recording medium and configured to guide the recording medium, at least one of the first guide portion and the second guide portion configured to move relative to the other.

* * * * *